US006148924A

United States Patent [19]

Shafer

[11] Patent Number: 6,148,924

[45] Date of Patent: Nov. 21, 2000

[54] METHOD AND APPARATUS FOR THE DISASSEMBLY OF DRILL PIPE

[75] Inventor: William C. Shafer, Berwick, La.

[73] Assignee: Oil & Gas Rental Services, Inc., La.

[21] Appl. No.: 09/189,961

[22] Filed: Nov. 10, 1998

[51] Int. Cl.[7] ..... E21B 19/16

[52] U.S. Cl. ..... 166/377; 166/77.51; 166/85.1; 166/380

[58] Field of Search ..... 166/377, 77.51, 166/380, 85.5, 85.1

[56] References Cited

U.S. PATENT DOCUMENTS

| | | | |
|---|---|---|---|
| 2,190,547 | 2/1940 | Le Bus | 166/77.52 |
| 2,412,875 | 12/1946 | Crane | 255/35 |
| 3,094,852 | 6/1963 | Taylor | 64/1 |
| 3,246,547 | 4/1966 | O'Neill et al. | 81/57.34 |
| 3,434,191 | 3/1969 | Timmons | 29/200 |
| 3,680,412 | 8/1972 | Mayer et al. | 81/57.34 |
| 3,957,113 | 5/1976 | Jones et al. | 166/77.5 |
| 4,192,533 | 3/1980 | Blose | 285/334 |
| 4,440,220 | 4/1984 | McArthur | 166/85 |
| 4,506,730 | 3/1985 | McCollin et al. | 166/85 |
| 4,697,830 | 10/1987 | Wood et al. | 285/27 |
| 4,747,454 | 5/1988 | Perryman | 166/380 |
| 4,844,171 | 7/1989 | Russell, Jr. | 166/377 |
| 4,867,236 | 9/1989 | Haney et al. | 166/77.5 |
| 5,361,831 | 11/1994 | Young | 166/77.5 |
| 5,454,605 | 10/1995 | Mott | 285/333 |
| 5,806,589 | 9/1998 | Lang | 166/77.53 |

*Primary Examiner*—Hoang Dang
*Attorney, Agent, or Firm*—Garvey, Smith, Nehrbass & Doody, LLC

[57] ABSTRACT

A method and apparatus for destabbing (disassembling) two vertically oriented drill pipe joint sections provides a two part clamp arrangement that holds the assembled joint at their interface. A lower end of the clamp arrangement is tightly clamped to the lower joint so that the upper joint rotates when the two joint are gripped with power tongs or like pipe handling devices and unthreaded or "destabbed".

16 Claims, 5 Drawing Sheets

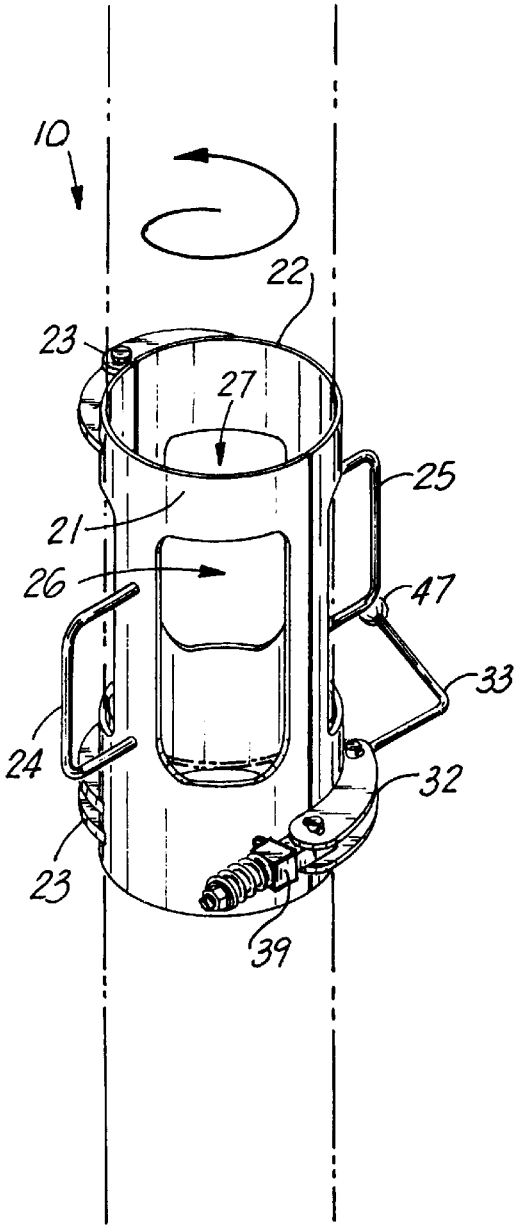
FIG. 1
FIG. 2
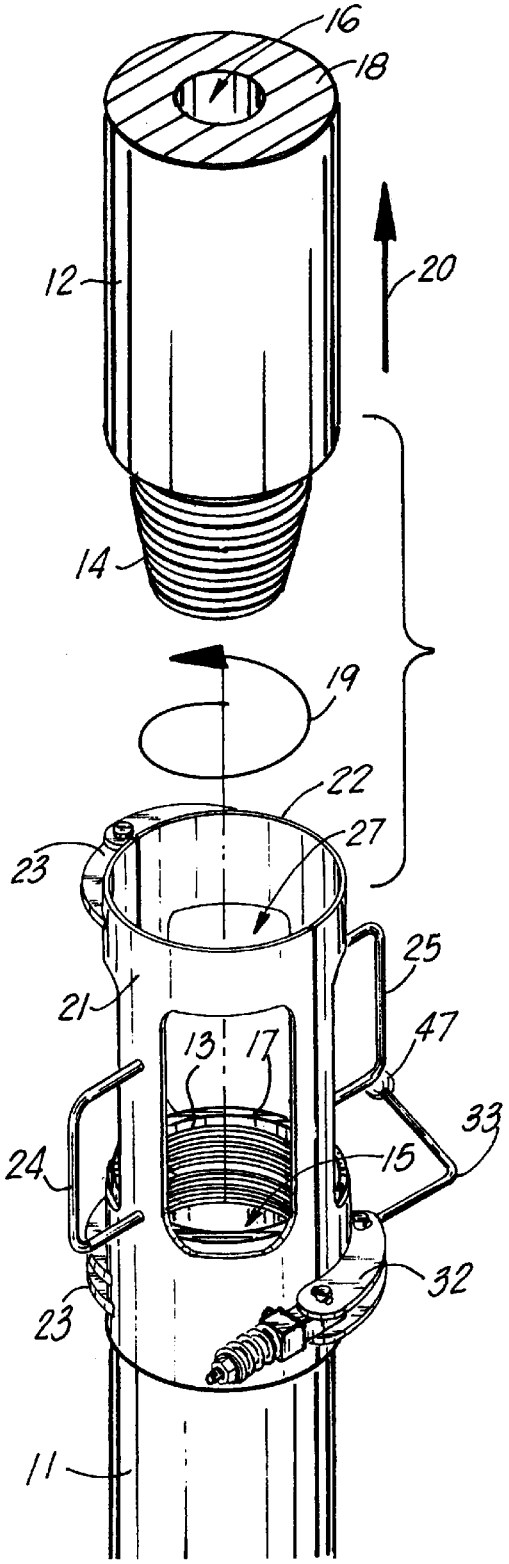

METHOD AND APPARATUS FOR THE DISASSEMBLY OF DRILL PIPE

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the disassembly or unthreading of pipe, specifically of oil and gas well drilling pipe and more particularly to an improved method and apparatus for enabling a user to disassemble or destab joints of oil field drill pipe and the like even in offshore marine conditions, e.g. on semisubmersible rigs and the like. Even more particularly, the present invention relates to an improved destabbing apparatus and its method of use wherein a cylindrically shaped sleeve having a hinged body enables the sleeve to be assembled and disassembled to a pair of connected joints of pipe, the lower end of the sleeve having a cam and clamp arrangement that securely fastens the sleeve to the lower of the two pipe joints enabling a user to "destab" (disassemble) the upper joint while the sleeve grips the lower joint.

2. General Background of the Invention

In the oil and gas well drilling industry, it is common to employ drill strings that are comprised of a number of lengths of drill pipe that are connected end to end. In some particular types of joints such as those that employ wedge threads, dovetail threads, taper threads and the like, excess thread wear and thread damage can more easily occur during destabbing operations. Further, rough seas cause floating oil well drilling vessels to pitch so that aligning pipe sections is difficult.

BRIEF SUMMARY OF THE INVENTION

The present invention provides an improved method of destabbing or disconnecting a pair of threadably interengaged and generally vertically oriented oil and gas well drill pipe sections that are connectable end to end at threaded pin and box joint connections.

The method first provides a pair of pipe joints to be joined, each having end portions with mating faces and threaded portions that are connected to similarly threaded portions of another joint.

During destabbing, a sleeve is affixed to the assembly of the pipe joints at the mating faces, wherein a lower end portion of the sleeve engages the lower joint and an upper end portion of the sleeve engages the upper joint.

The joints are then "destabbed" by rotating the upper joint relative to the lower joint and wherein the sleeve tightly engages the lower joint.

During this method, the longitudinal axes of the joints are maintained in alignment. The present invention also provides a pipe destabbing apparatus for disconnecting a pair of threadably connected pipe joints having threaded end portions and mating faces at the end portions.

The apparatus includes a sleeve having a pair of connected sections, means on the sleeve sections for enabling a user to manipulate the sleeve sections during use, at least one of the sleeve section having a window, the lower end of the sleeve having a compressive member for pressing the sleeve against the lower joint of the pair of assembled joint of pipe, and wherein the window enables the user to position the mating faces at the middle of the sleeve by visual inspection.

The upper end of the sleeve closely conforms to the upper joint of pipe and the compressive member applies sufficient load to the assembled joints at the lower joint so that when the two joints are rotated with respect to one another during disassembly or destabbing, the lower joint is affixed to the sleeve and the upper joint rotates with respect to the sleeve and lower joint.

BRIEF DESCRIPTION OF THE DRAWINGS

FIG. 1 is a perspective view of the preferred embodiment of the apparatus of the present invention;

FIG. 2 is a perspective view of the preferred embodiment of the apparatus of the present invention illustrating the destabbing of one joint of pipe from another joint of pipe;

For a further understanding of the nature, objects, and advantages of the present invention, reference should be had to the following detailed description, read in conjunction with the following drawings, wherein like reference numerals denote like elements and wherein:

DETAILED DESCRIPTION OF THE INVENTION

Figure 6:
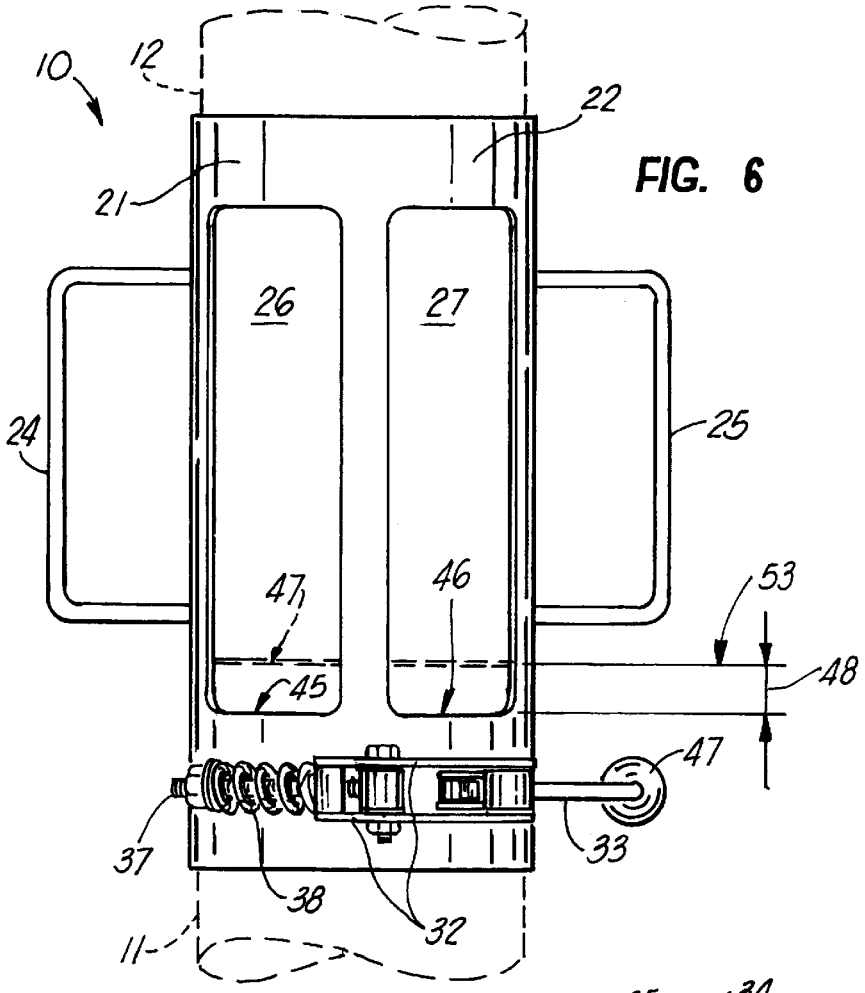
FIG. 6 is an elevational view of the preferred embodiment of the apparatus of the present invention.

FIGS. 1–6 show generally the preferred embodiment of the apparatus of the present invention designated generally by the numeral 10. Destabbing apparatus 10 includes a cylindrically shaped sleeve in the form of two semicircular clamp sections 21, 22 as shown in FIGS. 1–4. In the oil and gas well drilling industry, stabbing means to thread one joint of drill pipe that is vertically oriented into another joint of drill pipe that is vertically oriented such as occurs when running a drill string into the well. "Destabbing" refers to the disassembly or unthreading of an upper vertically oriented joint from a lower joint, such as occurs when pulling a pipe string out of a well. In FIGS. 2 and 6, a pair of joints of drill pipe are connected end to end including a lower joint 11 and an upper joint 12. The lower joint 11 provides a box end portion 13. The upper joint 12 provides a pin end portion 14. Each of the joints 11, 12 provides a longitudinally extending, typically cylindrically shaped open ended flow bore 15, 16 respectively.

Each of the joints 11, 12 provides a wall 17, 18 respectively. In FIG. 1, a rotation of the upper joint 12 with respect to the lower joint 11 in the direction of arrow 19 enables the threads at the box and pin end portions 13, 14 to be disassembled or "destabbed" so that the joint 12 can be separated from the joint 11 in the direction of arrow 20.

In FIGS. 1–5, destabbing apparatus 10 is the form of a cylindrically shaped sleeve that includes clamp sections 21, 22 connected together with upper and lower hinges 23. Handles 24, 25 enable a user to grip the respective clamp sections 21, 22 during assembly and during disassembly of the apparatus 10 to a pair of connected joints 11, 12.

A pair of windows 26, 27 are provided respectively upon clamp sections 21, 22 as shown in FIGS. 1, 2, 3 and 6. The windows 26, 27 enable a user to place the apparatus 10 in the correct position upon a pair of assembled joints 11, 12. Preferably, the respective lower end portions 45, 46 of the windows 26, 27 are placed immediately below the upper transverse surface 47 of the lower joint 11, a distance indicated by arrow 48 as shown in FIG. 6. In this fashion, the user ensures that the apparatus 10 will be clamped to the upper end of the lower joint 11.

Figure 3:
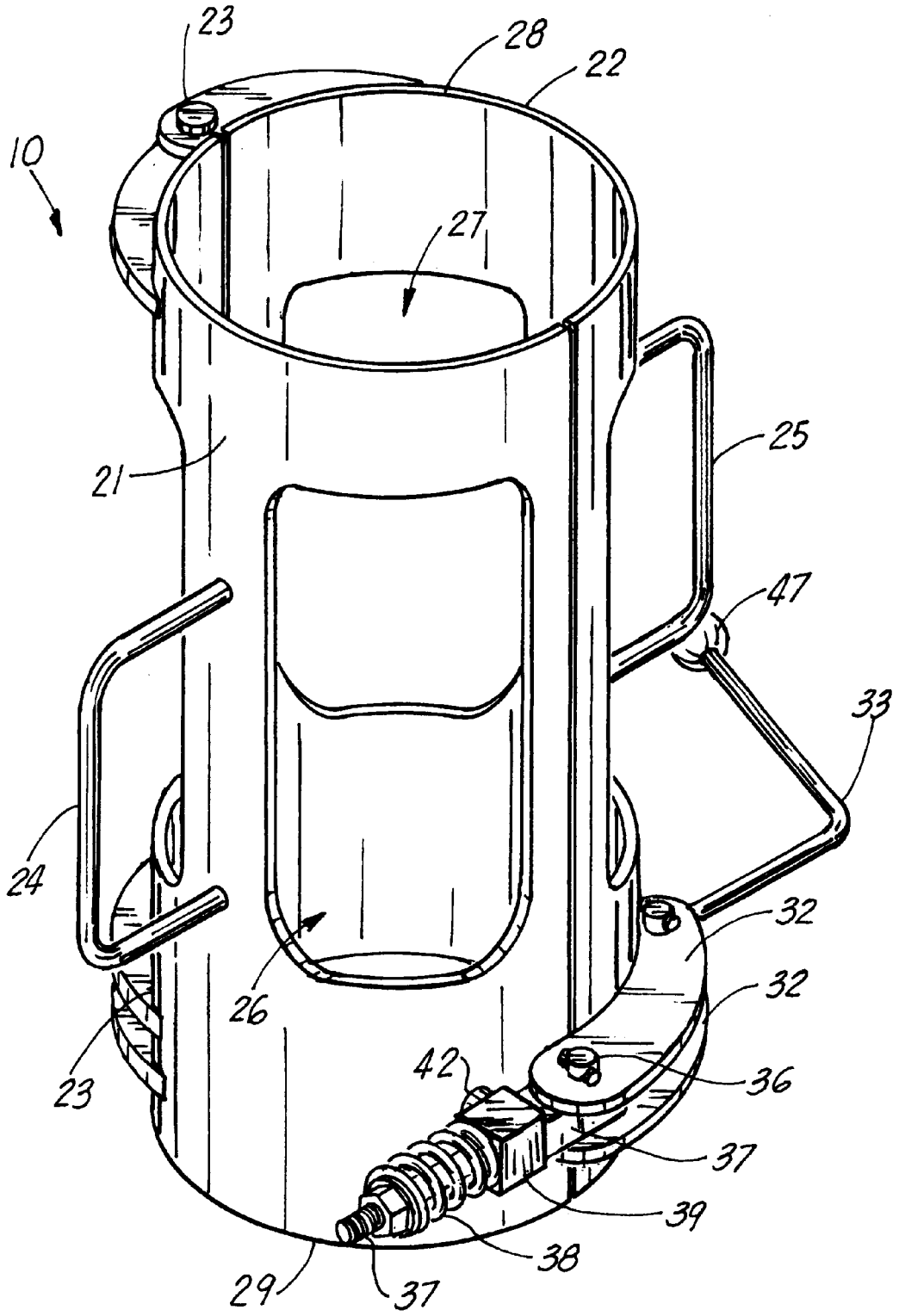
FIG. 3 is a perspective view of the preferred embodiment of the apparatus of the present invention.

Because the upper end portion of the clamped sections 21, 22 are not provided with a clamp mechanism (such as the mechanism 40 at the bottom of the apparatus 10), only the bottom part of the apparatus 10 is tightly clamped to the lower joint 11. This construction enables the upper joint 12 to rotate freely with respect to the clamp sections 21, 22 during destabbing. Each of the clamp sections 21, 22 provides and upper annular edge 28 and a lower annular edge 29. The windows 26, 27 are space downwardly from the upper annular edge 28 and upwardly from the lower annular edge 29 as shown in FIG. 3.

Clamp mechanism 40 is shown more particularly in FIGS. 3–4 and 6–8. Clamp mechanism 40 is mounted at weldment 42 to clamp section 21. The weldment 42 carries a square block like body 39 with a central longitudinal bore 43 through which threaded fastener 37 passes. Threaded fastener 37 attaches at hinge 36 to link 32. The opposite end of threaded member 37 carries washer 41 and nut 43.

Figure 4:
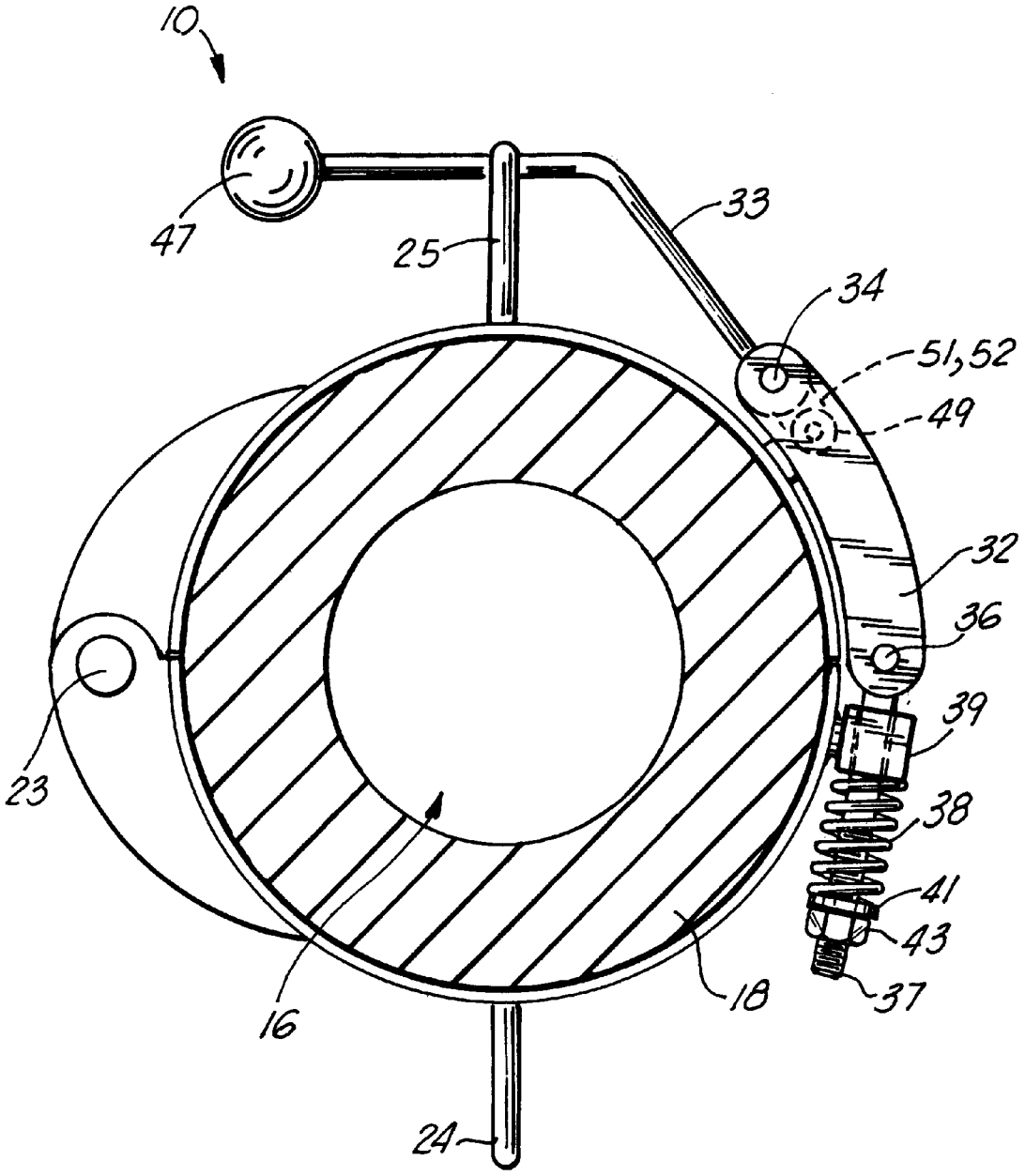
FIG. 4 is a top view of the preferred embodiment of the apparatus of the present invention.
Figure 5:
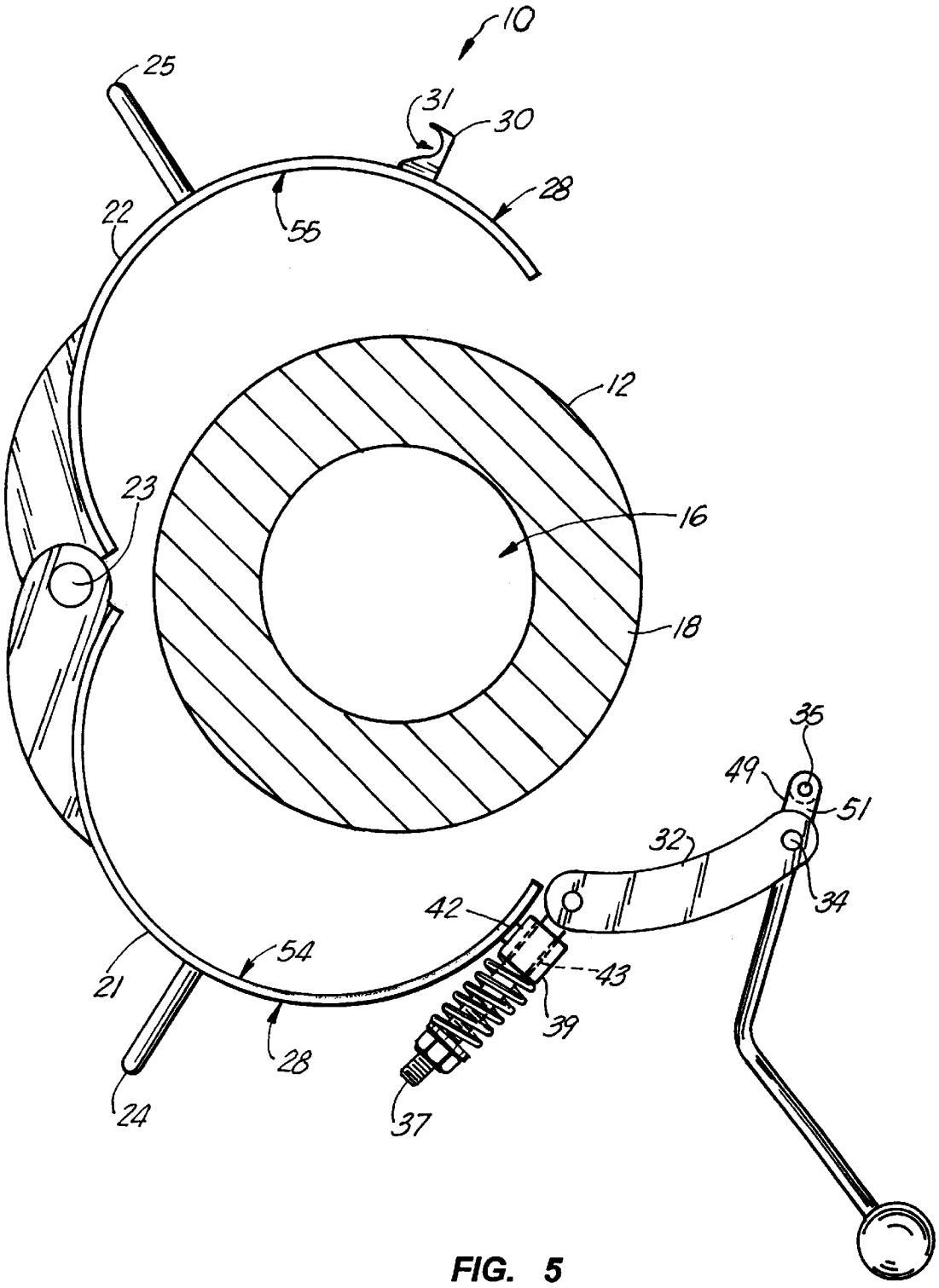
FIG. 5 is a top view of the preferred embodiment of the apparatus of the present invention showing the body in an open position.

Spring 38 is positioned in between body 39 and washer 41 as shown in FIG. 4. Handle 33 is pivotally attached at pivot 34 to link 32. Cam 35 at one end of handle 33 is provided for engaging the recess 31 of catch 30. In order to close clamp sections 21, 22, a user holds knob 47 of handle 33 and manipulates the handle 33 until cam roller 49 engages the recess 31. The user then rotates the handle 33 in the direction of arrow 44 in FIGS. 4 and 8.

Figure 7:
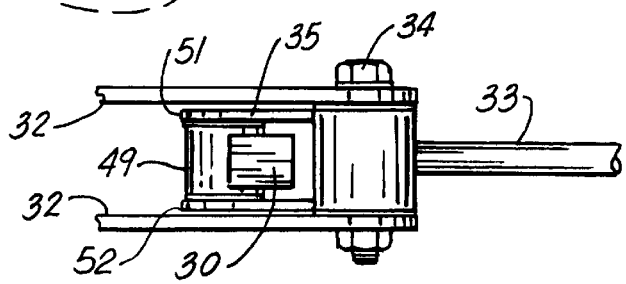
FIGS. 7–8 are fragmentary views showing the locking cam position.
Figure 8:
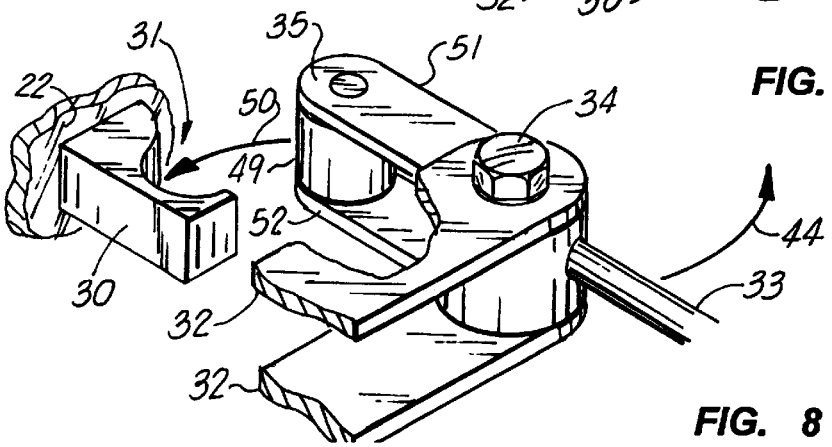

Cam roller 49 engages recess 31 of catch 30 that is welded to clamp section 22. Continued rotation of handle 33 in the direction of arrow 44 similarly rotates cam roller 49 in the direction of arrow 50. Cam links 51, 52 nest in between links 32 as shown in FIGS. 4, 6–7 as closure is completed.

Tension in spring 38 can be varied by tightening or loosening nut 37 on threaded fastener 37 to vary the distance between washer 41 and block 39. When handle 33 is rotated to the fully closed position of FIG. 4, threaded fastener 37 moves relative to bore 43 so that spring 38 can be compressed to load the connection of cam roller 49 to catch 30.

The inside surfaces of clamp sections 21, 22 are curved to conform to the outer surfaces of pipe sections 11, 12. However, the inside surfaces of the clamp sections 21, 22 can be slightly cut away above a horizontal line 53 that is also represented by transverse face 47 of lower joint 11 (see FIG. 6).

Such a cut-away surface could be a few, for example only a few tenths of a millimeter, allowing upper joint 12 to rotate a little more freely relative to lower joint 11 during destabbing. However, it has been found that the inside surfaces 54, 55 of respective clamp sections 21, 22 can define a cylinder with uniform transverse cross section since clamp mechanism 40 tightly grips lower section 11 during destabbing.

The following table lists the parts numbers and parts descriptions as used herein and in the drawings attached hereto.

PARTS LIST

| Part Number | Description |
|---|---|
| 10 | destabbing apparatus |
| 11 | joint |
| 12 | joint |
| 13 | box end |
| 14 | pin end |
| 15 | flow bore |
| 16 | flow bore |
| 17 | wall |
| 18 | wall |
| 19 | arrow |
| 20 | arrow |
| 21 | clamp section |
| 22 | clamp section |
| 23 | hinge |
| 24 | handle |
| 25 | handle |
| 26 | window |
| 27 | window |
| 28 | upper edge |
| 29 | lower edge |
| 30 | catch |
| 31 | recess |
| 32 | link |
| 33 | handle |
| 34 | pivot |
| 35 | cam |
| 36 | pivot |
| 37 | threaded member |
| 38 | spring |
| 39 | body |
| 40 | clamp mechanism |
| 41 | washer |
| 42 | weldment |
| 43 | nut |
| 44 | arrow |
| 45 | lower end portion |
| 46 | lower end portion |
| 47 | knob |
| 48 | arrow |
| 49 | cam roller |
| 50 | arrow |
| 51 | cam link |
| 52 | cam link |
| 53 | line |
| 54 | inside surface |
| 55 | inside surface |

The foregoing embodiments are presented by way of example only; the scope of the present invention is to be limited only by the following claims.

What is claimed is:

1. A method of destabbing a pair of threadably interengaged and generally vertically oriented oil and gas well drill pipe sections that are connectable end-to-end at threaded pin and box joint connections, comprising the steps of:

a) providing a pair of pipe joints to be joined, each joint having a generally cylindrically shaped outer surface, end portions with mating faces, and threaded portions that connect to similarly threaded portions of another joint;

b) connecting the joints of pipe together;

c) affixing a sleeve to the assembly of pipe joints at the mating faces, wherein a lower end portion of the sleeve has a generally cylindrically shaped interior surface that conforms to the lower joint and an upper end portion of the sleeve has a generally cylindrically shaped interior surface that conforms to engages the upper joint;

d) destabbing the joints by rotating the upper joint relative to the lower joint and wherein the sleeve lower end portion is configured to tightly engage the lower joint during rotation of the upper joint, and the sleeve upper end portion loosely engages the upper joint during such rotation so that simultaneous rotation and alignment is enabled;

e) wherein in step "d" the central longitudinal axes of the joints are maintained in alignment.

2. The method of claim 1 wherein step "c" comprises affixing a sleeve comprised of two connectable sleeve half sections to the assembly of pipe joints at the mating faces, wherein a lower end portion of the sleeve engages the lower joint and an upper end portion of the sleeve engages the upper joint.

3. The method of claim 1 wherein step "c" comprises affixing a sleeve comprised of two connectable sleeve half sections to the assembly of pipe joints at the mating faces, and further comprising the step of locking a lower end portion of the sleeve to the lower joint.

4. The method of claim 1 further comprising the step of cam locking the lower end portion of the sleeve to the lower of the joints.

5. The method of claim 1 wherein step "e" comprises maintaining the central longitudinal axes of the joints in alignment by closely conforming the sleeve to both upper and lower joints during destabbing in step "d".

6. The method of claim 5 wherein the upper end portion of the sleeve loosely engages the upper pipe joint.

7. The method of claim 5 wherein the upper end portion of the sleeve engages the upper pipe joint with insufficient force to overcome the connection between the sleeve and the lower joint.

8. The method of claim 4 wherein the upper end portion of the sleeve engages the upper pipe joint with insufficient force to overcome the cam locking connection between the sleeve and the lower joint.

9. A method of destabbing a pair of threadably interengaged and generally vertically oriented oil and gas well drill pipe sections that are connectable end-to-end at threaded pin and box joint connections, comprising the steps of:

a) providing a pair of pipe joints to be joined, each joint having end portions with mating faces and threaded portions that connect to similarly threaded portions of another joint;

b) connecting the joints of pipe together:

c) affixing a sleeve to the assembly of pipe joints at the mating faces, wherein a lower end portion of the sleeve engages the lower joint and an upper end portion of the sleeve enrages the upper joint;

d) destabbing the joints by rotating the upper joint relative to the lower joint and the sleeve that engages the lower joint;

e) wherein in step "d" the central longitudinal axes of the joints are maintained in alignment; and f) wherein the sleeve has an inner diameter that is smaller at the lower end portion of the sleeve than at the upper end portion of the sleeve.

10. A method of destabbing a pair of connected oil and gas well drill pipe sections that are connectable end-to-end at threaded pin and box joint connections, comprising the steps of:

a) providing a pair of pipe joints to be joined, each joint having a generally cylindrically shaped outer surface, end portions with mating faces, and threaded portions that connect to similarly threaded portions of another joint;

b) connecting the joints of pipe together;

c) affixing a detachable sleeve to the assembly of pipe joints at the mating faces, the sleeve comprising a pair of connectable sections, each having a generally cylindrically shaped inner surface that conforms to a cylindrical surface of a pipe joint outer surface; wherein a lower end portion of the sleeve tightly engages the lower joint and an upper end portion of the sleeve loosely engages the upper joint;

d) wherein in step "c" the lower end of the sleeve is locked to the lower of the joints;

e) destabbing the joints by rotating the upper joint relative to the lower joint and the sleeve that engages the lower joint; and f) wherein in step "d" the central longitudinal axes of the joints are maintained in alignment.

11. A pipe destabbing apparatus for destabbing a pair of pipe joints having threaded end portions and mating faces at the end portions, comprising:

a) a sleeve having a pair of connectable sections;

b) handles on the sleeve sections for enabling a user to manipulate the sleeve;

c) at least one of the sleeve sections having a window;

d) the lower end of the sleeve having a locking closure member for affixing the sleeve to a pair of assembled joints of pipe;

e) the window enabling the user to position the mating faces at the middle of the sleeve by visual inspection.

12. The destabbing apparatus of claim 11 wherein the connectable sections are hingedly attached.

13. The destabbing apparatus of claim 11 wherein a cam locking mechanism is included in the locking closure.

14. The destabbing apparatus of claim 11 wherein the sleeve has upper and lower edge portions and the window extends at least about half the distance between the upper and lower edges.

15. The destabbing apparatus of claim 11 wherein the locking closure includes a spring loaded member that applies spring tension to the connectable sections for compressing the sleeve against the lower joint of pipe.

16. A pipe destabbing apparatus for destabbing a pair of connected pipe joints having threaded end portions and mating faces at the end portions, comprising:

a) a sleeve having a pair of connectable sections;

b) means on the sleeve sections for enabling a user to manipulate the sleeve sections during use;

c) at least one of the sleeve sections having a window;

d) the lower end of the sleeve having a compressive member for pressing the sleeve against the lower joint of the pair of assembled joints of pipe;

e) the window enabling the user to position the mating faces at the middle of the sleeve by visual inspection;

f) the upper end of the sleeve closely conforming to the upper joint of pipe; and g) wherein the compressive member applies sufficient load to the assembled joints at the lower joint so that when the two joints are rotated with respect to one another during destabbing, the lower joint is affixed to the sleeve and the upper joint rotates with respect to the sleeve and the lower joint.

* * * * *